US009380364B2

(12) United States Patent
Chen et al.

(10) Patent No.: US 9,380,364 B2
(45) Date of Patent: Jun. 28, 2016

(54) ELECTRONIC DEVICE AND ELECTRONIC ASSEMBLY

(71) Applicant: Acer Incorporated, New Taipei (TW)

(72) Inventors: Hung-Chi Chen, New Taipei (TW); Pin-Chueh Lin, New Taipei (TW)

(73) Assignee: Acer Incorporated, New Taipei (TW)

( * ) Notice: Subject to any disclaimer, the term of this patent is extended or adjusted under 35 U.S.C. 154(b) by 44 days.

(21) Appl. No.: 14/555,564

(22) Filed: Nov. 26, 2014

(65) Prior Publication Data

US 2015/0341711 A1 Nov. 26, 2015

(30) Foreign Application Priority Data

May 23, 2014 (TW) ..... 103118062 A

(51) Int. Cl.
*H04R 1/02* (2006.01)
*H04R 5/02* (2006.01)

(52) U.S. Cl.
CPC ..... *H04R 1/02* (2013.01); *H04R 1/025* (2013.01); *H04R 5/02* (2013.01); *H04R 2201/025* (2013.01); *H04R 2499/15* (2013.01)

(58) Field of Classification Search
None
See application file for complete search history.

(56) References Cited

U.S. PATENT DOCUMENTS

2006/0128441 A1 6/2006 Kim
2011/0129109 A1 6/2011 Okutsu

*Primary Examiner* — Wayne Young
*Assistant Examiner* — Mark Fischer
(74) *Attorney, Agent, or Firm* — Jianq Chyun IP Office

(57) ABSTRACT

An electronic device including a body, a speaker, and a latch is provided. The speaker has a first rail. The speaker and the latch are movably assembled to the body respectively. The latch is coupled to both of the first and the second rails, wherein the first rail and the second rail have an acute angle therebetween. An object is suited for being assembled to the body detachably and pushes the latch to move along the first and the second rails at the same time, such that the latch drives a portion of the speaker to protrude out of the body. An electronic assembly is also provided.

13 Claims, 7 Drawing Sheets

ELECTRONIC DEVICE AND ELECTRONIC ASSEMBLY

CROSS-REFERENCE TO RELATED APPLICATION

This application claims the priority benefit of Taiwan application serial no. 103118062, filed on May 23, 2014. The entirety of the above-mentioned patent application is hereby incorporated by reference herein and made a part of this specification.

BACKGROUND OF THE INVENTION

1. Field of the Invention

The invention relates to an electronic device and an electronic assembly, and particularly relates to an electronic device and an electronic assembly with a speaker having a variable speaker box capacity.

2. Description of Related Art

As science and technology advance, a variety of portable electronic devices have been broadly used in our daily lives. The portable electronic devices are generally designed with the objective of having a light, thin, and compact external appearance for the ease of being carried around.

In generally, the portable electronic devices are mounted with small speakers for the purpose of audiovisual entertainment. However, the capability of this kind of small speakers to play music or sounds is usually equivalent to or slightly better than buzzers. The loudness and sound quality of sounds produced by the small speakers are less than ideal. The main reason is that these speakers are confined by the external appearance design and capacity of sound producing elements and sound boxes. Also, due to the special requirement that the external appearance of the portable electronic devices needs to be light and thin, it is inevitable to make sacrifice to the capacity of the speaker or design the speaker to be a flat structure. However, such sacrifice and design tend to make the speaker box of the speaker overly small and lose the function it should have.

This is because the design of speaker box structure has a crucial influence on the overall efficiency and sound performance of the speaker. Thus, how to meet the requirement on the external appearance design of the portable electronic devices and the sound quality of speakers at the same time is certainly an issue that relevant researchers need to work on.

SUMMARY OF THE INVENTION

The invention provides an electronic device and an electronic assembly with a speaker having a variable speaker box capacity and capable of improving sound quality.

An electronic device of the invention includes a body, a speaker, and a latch. The speaker and the latch is movably assembled to the body. The speaker has a first rail, and the body has a second rail. The latch is simultaneously coupled to the first rail and the second rail, and an acute angle is included between the first rail and the second rail. An object is adapted to be detachably combined to the body and push the latch to move along the first rail and the second rail simultaneously, so as to make the latch drive a part of the speaker to protrude out of the body.

An electronic assembly of the invention includes a first body, a speaker, a latch, and a second body. The speaker and the latch are movably assembled to the first body. The speaker has a first rail, and the first body has a second rail. The latch is simultaneously coupled to the first rail and the second rail, and an acute angle is included between the first rail and the second rail. A second body is adapted to be detachably combined to the first body and push the latch to move along the first rail and the second rail simultaneously, so as to make the latch drive a part of the speaker to protrude out of the body.

Based on the above, by setting the first rail of the speaker and the second rail of the first body to include an acute angle, thus making the latch coupled to the first rail and the second rail simultaneously, a linkage mechanism is formed between the speaker, the latch, and the body. Therefore, when the object (or the second body) is assembled to the first body, the object (or the second body) pushes the latch to make the latch move along the first rail and the second rail simultaneously, so as to drive the speaker. Consequently, the speaker is driven by the latch to protrude out of or be submerged into the first body. Such design allows the speaker to have a variable capacity. Namely, a speaker box capacity of the speaker may be increased as the speaker protrudes out of the first body. Therefore, the speaker is allowed to maintain the sound effect thereof without being confined by an external appearance of the first body.

To make the above features and advantages of the invention more comprehensible, embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
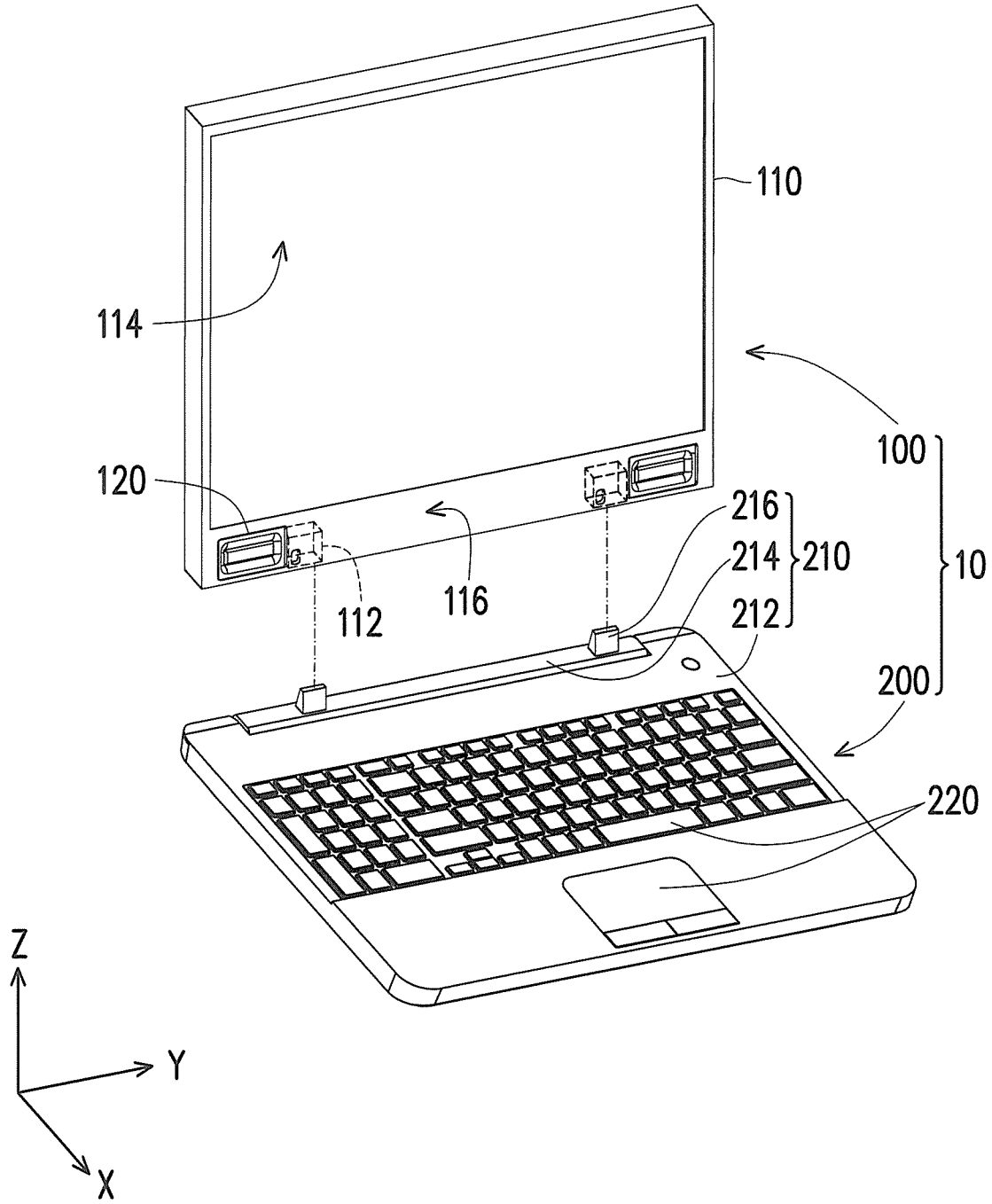
FIG. 1 is a schematic view illustrating an electronic assembly according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
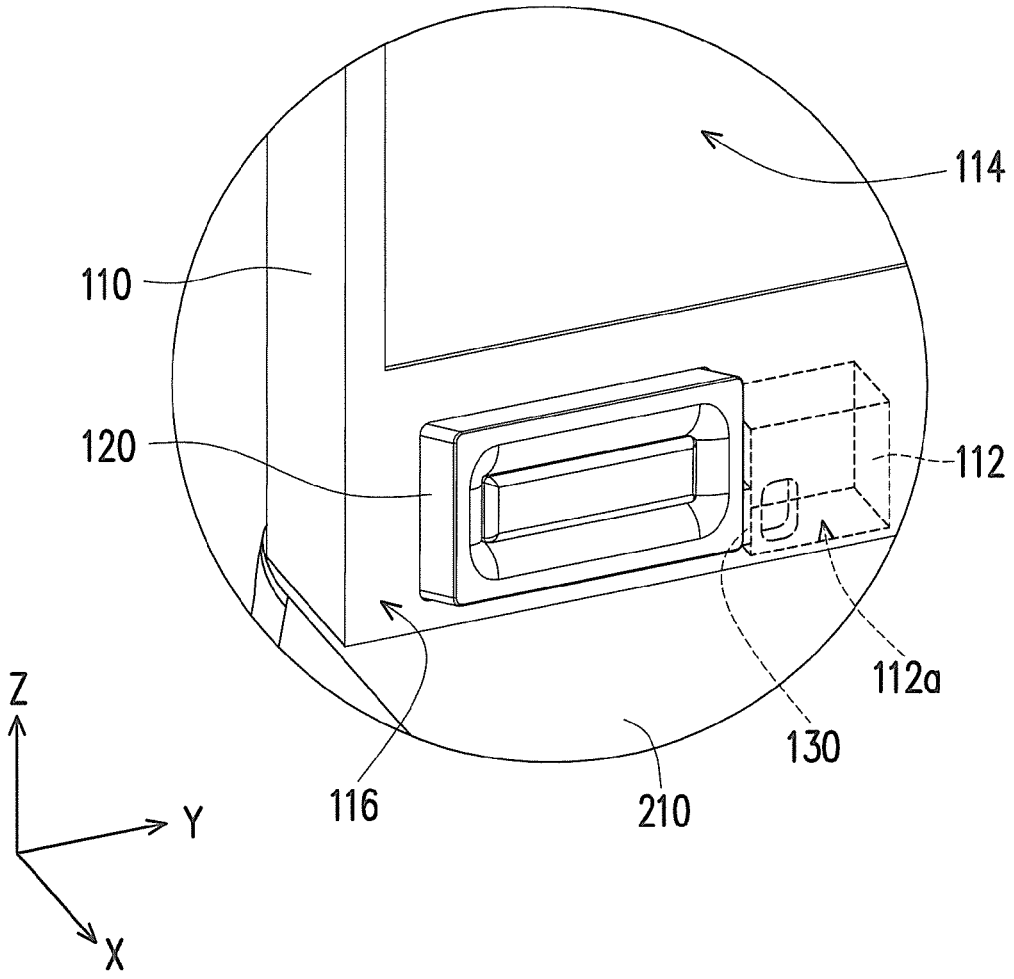
FIG. 2 is a partial schematic view illustrating the electronic assembly of FIG. 1 after being assembled.

FIG. 1 is a schematic view illustrating an electronic assembly according to an embodiment of the invention. FIG. 2 is a partial schematic view illustrating the electronic assembly of FIG. 1 after being assembled. Referring to FIGS. 1 and 2 simultaneously, in this embodiment, an electronic assembly 10 includes an electronic device 100 and an expansion base 200. In addition, the electronic device 100 is a tablet computer, for example, and the expansion base 200 is an input module including a keyboard and a touch pad, for example, configured as an option for the user to operate the electronic device 100 after being assembled with the electronic device 100. However, the invention does not intend to limit types of the electronic device 100 and the expansion base 200. In another embodiment not shown herein, the electronic device may also be a smart phone, and the expansion base may also be a charging seat to carry and provide power to the electronic device at the same time. Thus, the invention applies to any detachable structures or devices providing an additional function when being assembled together.

The electronic device 100 includes a first body 110, a speaker 120, and a latch 130. The first body 110 has a display 114, a component 112, and a notch 112*a*. In addition, the display 114 is a plane parallel to the Y-Z plane in FIG. 1, while the notch 112*a* is facing toward the negative Z-axis direction in FIG. 1. The speaker 120 and the latch 130 are movably assembled inside the first body 110, the latch 130 is capable of moving back and forth along Z-axis, and the speaker 120 is capable of moving back and forth along the X-axis. Correspondingly, the expansion base 200 includes a second body 210 and an input element 220 (e.g. a keyboard or touch pad as shown in the figure, but the invention is not limited thereto). In addition, the second body 210 includes a main body 212, a hinge 214, and a protruding part 216. The input element 220 is disposed on the main body 212, the hinge 214 is rotatably connected to a side edge of the main body 210 about the Y-axis, and the protruding part 216 is disposed on the hinge 214.

As shown in FIG. 1, by combination of the protruding part 216 and the notch 112*a*, the electronic device 100 and the expansion base 220 are structurally and electrically assembled together. In addition, with the hinge 214, the electronic device 100 is allowed to rotate with respect to the main body 212. Thus, the user may operate the electronic device 100 by using the input element 220 and adjust a viewing angle of the display 114 with respect to the user based on the user's needs. Here, an assembling configuration between the electronic device 100 and the expansion base 200 is not limited. Assembling of the electronic device 100 and the expansion base 200 may be achieved by making the protruding part 216 extend into the notch 112*a* by using conventional assembling techniques such as engagement, magnetic suction, etc. with relevant techniques of connectors. Meanwhile, the protruding part 216 may also serve as a supporting structure of the electronic device 100.

Relevant components, such as the protruding part 216, the notch 112*a*, and the speaker 120 shown in this embodiment are respectively disposed at two opposite sides of the expansion base 200 and the electronic device 100 symmetrically. Therefore, in the following description, only components at one of the two sides are described, and the components at the other side are omitted as these components have the same features. Moreover, to keep lines for describing the components in the drawings simple and explicit, the component 112 and the latch 130 are drawn in dotted lines in FIGS. 1 and 2, while detailed illustration and description will be provided in the subsequent drawings.

Figure 3:
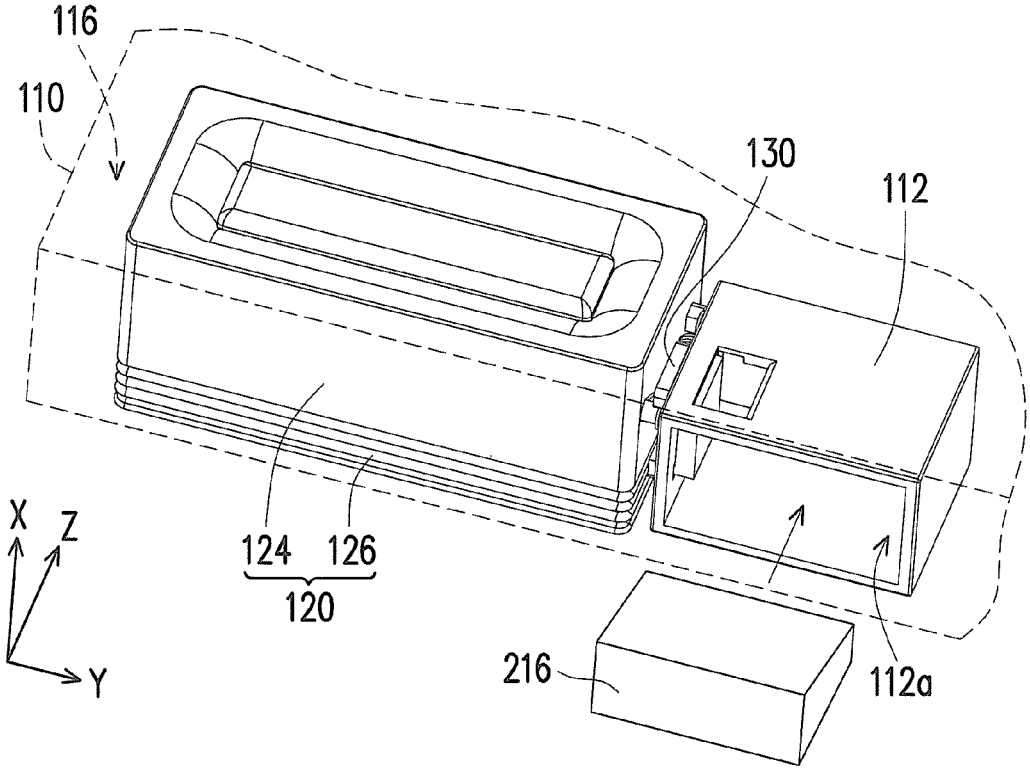
FIGS. 3 and 4 are respectively partial schematic views illustrating an electronic device shown in FIGS. 1 and 2.
Figure 4:
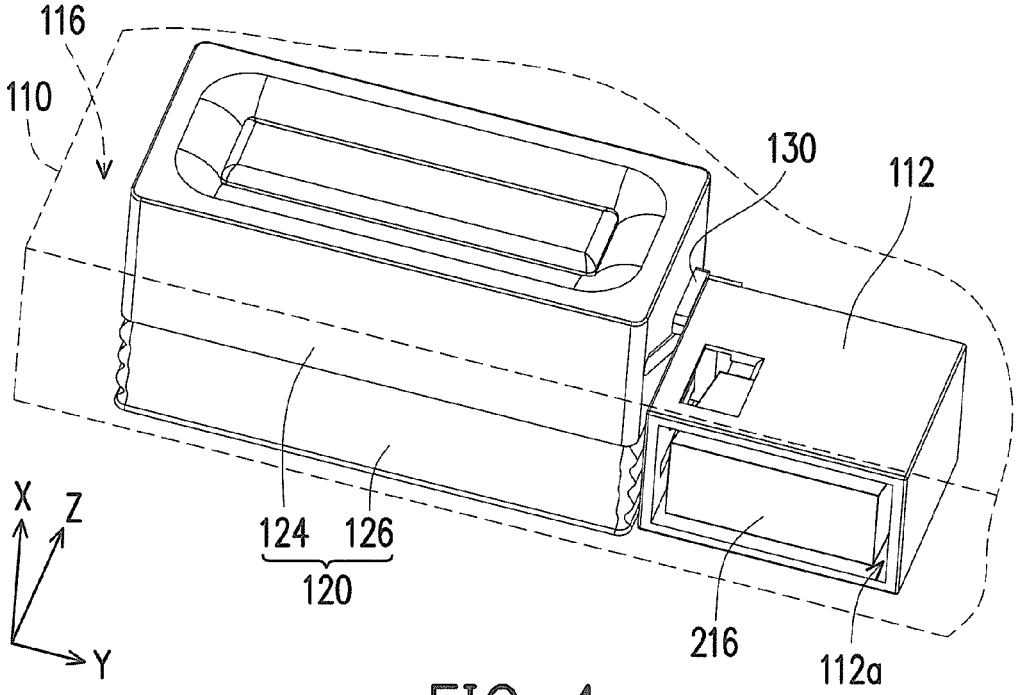

FIGS. 3 and 4 are respectively partial schematic views illustrating the electronic device shown in FIGS. 1 and 2. In addition, a state of the speaker shown in FIG. 3 corresponds to FIG. 1, while a state of the speaker shown in FIG. 4 corresponds to FIG. 2. Here, dotted lines are used to illustrate the first body 110 to clearly identify structural features in the first body 110. Referring to FIGS. 3 and 4 together with reference to FIGS. 1 and 2 as well, as previously noted, the latch 130 is capable of moving back and forth along the Z-axis, while the speaker 120 is capable of moving back and forth along the X-axis. Thus, when the protruding part 216 of the expansion base 200 moves into the notch 112*a* of the electronic device 100, the latch 130 is driven to move along the positive Z-axis direction, and the latch 130 thus drives the speaker 120 to move along the positive X-axis direction and protrude out of a surface 116 of the first body 110, as shown in FIGS. 2 and 4. Namely, the state shown in FIG. 3 is changed into the state shown in FIG. 4. It should be noted that although the component 112 serves as a component of the body to carry the latch 130 and is characterized as having the notch 112*a*, the component 112 may substantially be a structure integrally formed with the first body 110 and may be considered as a part of the first body 110.

Figure 5:
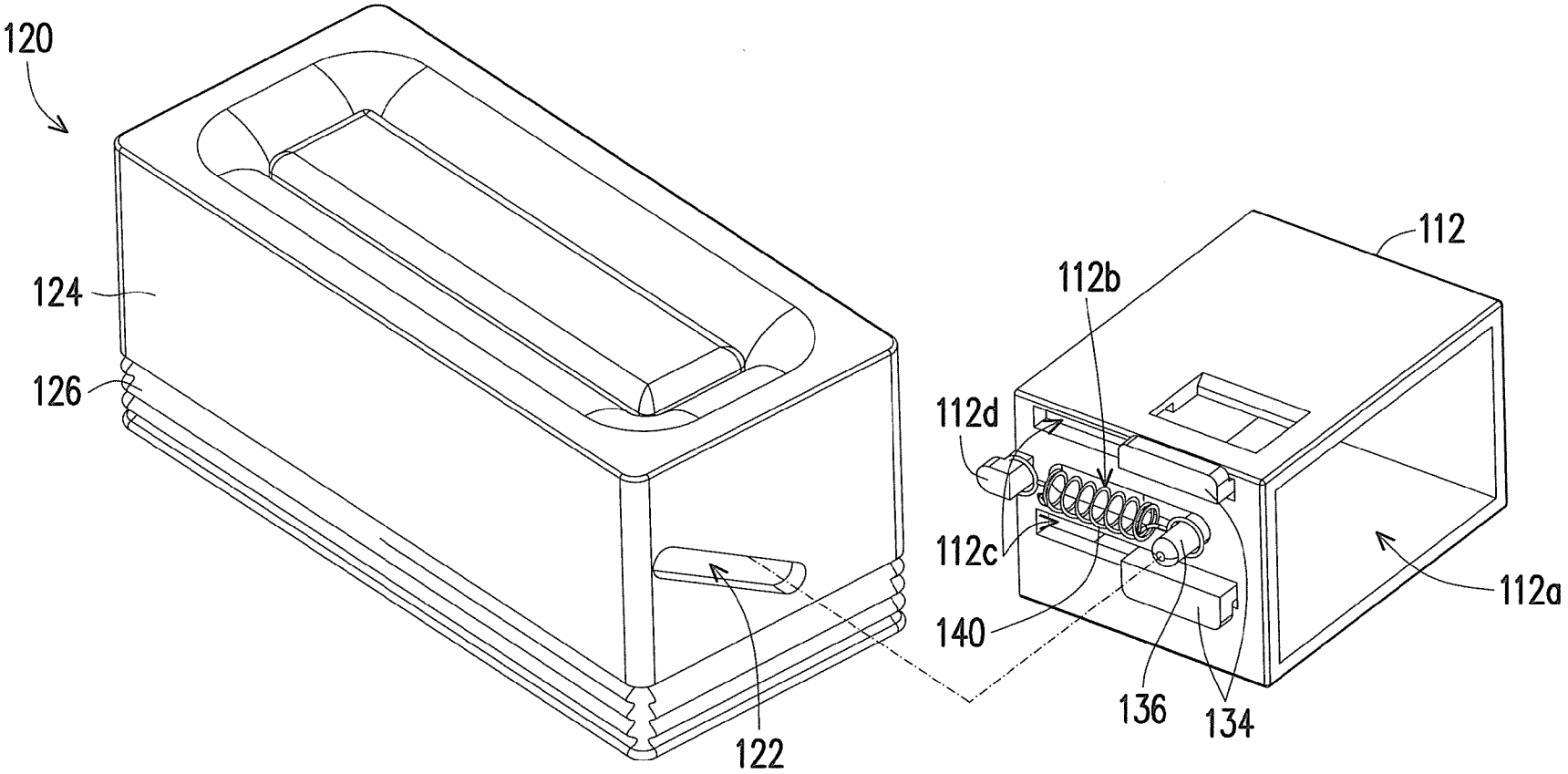
FIGS. 5 and 6 are respectively exploded views illustrating part of components inside an electronic device.
Figure 6:
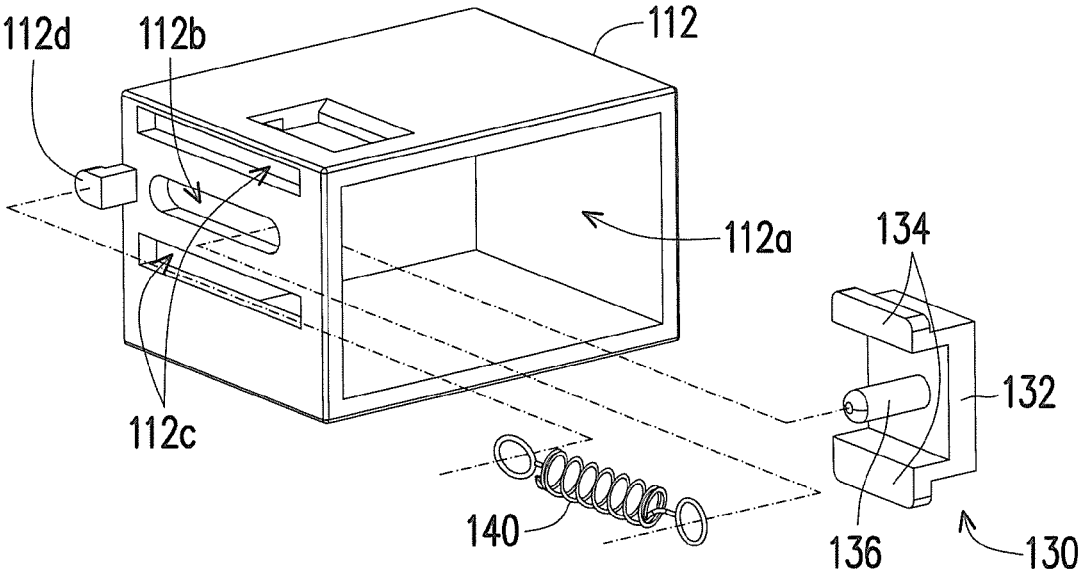

FIGS. 5 and 6 are respectively exploded views illustrating part of components inside an electronic device. Referring to FIGS. 5 and 6 together, specifically, the speaker 120 includes a first rail 122, a speaker portion 124, and a bellows portion 126. In addition, the first rail 122 is disposed on a side surface of the speaker portion 124 and substantially faces toward the component 112. The bellows portion 126 is disposed inside the first body 110 and expands or shrinks along the Z-axis. The speaker portion 124 is assembled on the bellows portion 126. Due to a foldable feature of the bellows portion 126, the speaker portion 124 may be substantially considered as a floating component disposed inside the first body 110.

Correspondingly, the component 112 has a second rail 112*b* facing toward the first rail 122, and the latch 130 is movably coupled to the first rail 122 and the second rail 112*b* at the same time. In this embodiment, the first rail 122 and the second rail 112*b* are respectively located on different planes parallel to the X-Z plane, and an acute angle is included between orthogonal projections of the first rail 122 and the second rail 112*b* on the X-Z plane. Moreover, the latch 130 is serially connected to the first rail 122 and the second rail 112*b* along the Y-axis, so a structure similar to a linkage structure is formed between the speaker 120 having the first rail 122, the latch 130, and the component 112 having the second rail 112*b* (may be considered as the first body 110) to achieve a linkage effect between components. Therefore, movement of any one of the components may influence the other two components.

Accordingly, it can be learned from FIGS. 3 to 5 that the second rail 112*b* is substantially parallel to the Z-axis, and the first rail 122 is tilted with respect to the Z-axis. Therefore, when the latch 130 moves along the second rail 112*b* (i.e. Z-axis), the latch 130 also moves along the first rail 122. Since the speaker portion 124 is substantially in a floating state, the speaker portion 124 is driven by the latch 130 to move along the X-axis. In this way, the speaker portion 124 protrudes out of the surface 116 of the first body 110, as shown in FIG. 2, or be submerged under the surface 116 of the first body 110.

More specifically, referring to FIGS. 5 and 6 simultaneously, the component 112 further has a pair of third rails 112*c* located on the same side surface as the second rail 112*b*. The pair of third rails 112*c* are respectively parallel to the second rail 112*b* and make the second rail 112*b* located between the pair of third rails 112*c*. The latch 130 includes a pushing part 132, a pair of wing parts 134 located at opposite sides of the pushing part 132, and a pillar 136 disposed on the pushing part 132 and located between the wing parts 134. In addition, the pillar 136 extends toward the speaker 120, passes through and is coupled to the first rail 122 and the second rail 112*b* simultaneously. As noted previously, the component 112 may be considered as a part of the first body 110. Therefore, from the perspective of the notch 112*a*, the second rail 112 is substantially located on a sidewall in the notch 112*a*, a part of the latch 130 (i.e. the pillar 136) passes through the sidewall, and another part of the latch 130 (i.e. the pushing part 132) is protruding in the notch 112*a* and located on a moving path that the protruding part 216 of the second body 210 moves into the notch 112*a*. Moreover, a direction of an opening of the notch 112*a* is substantially parallel to the second rail 112*a*. Consequently, when the first body 110 and the second body 210 are combined, the protruding part 216 directly pushes the pushing part 132 of the latch 130 along the second rail 112*a* in a mutual assembling axial direction (equivalent to Z-axis) of the first body 110 and the second body 210.

In addition, the wing parts 134 are respectively and correspondingly coupled to the third rails 112*c* and located at opposite sides of the pillar 136. The wing parts 134 are configured to avoid rotation (about the pillar 136) when the pushing part 132 and the pillar 136 move along the second rail 112*a*.

Besides, in this embodiment, the electronic device 100 further includes an elastic member 140 connected between the first body 110 and the latch 130. Specifically, the elastic member 140 is a compressible spring. One end of the elastic member 140 is disposed on the pillar 136 of the latch 130, and the other end of the elastic member 140 is disposed on a protruding part 112*d* of the component 112. When the second body 210 is combined to the first body 110 to make the protruding part 216 of the second body 210 push the pushing part 132 of the latch 130, thereby making the latch 130 move from a position shown in FIG. 3 to a position shown in FIG. 4, the latch 130 (compressively) deforms the elastic member 140. Thus, when the first body 110 is detached from the second body 120, namely when the protruding part 216 is moved out from the notch 112, a restoring force of the elastic member 140 drives the latch 130 to restore to the position shown in FIG. 3. Meanwhile, since the pillar 136 is restored, the latch 130 drives the speaker 120 to restore from the state shown in FIG. 2 to the state shown in FIG. 1.

Figure 7:
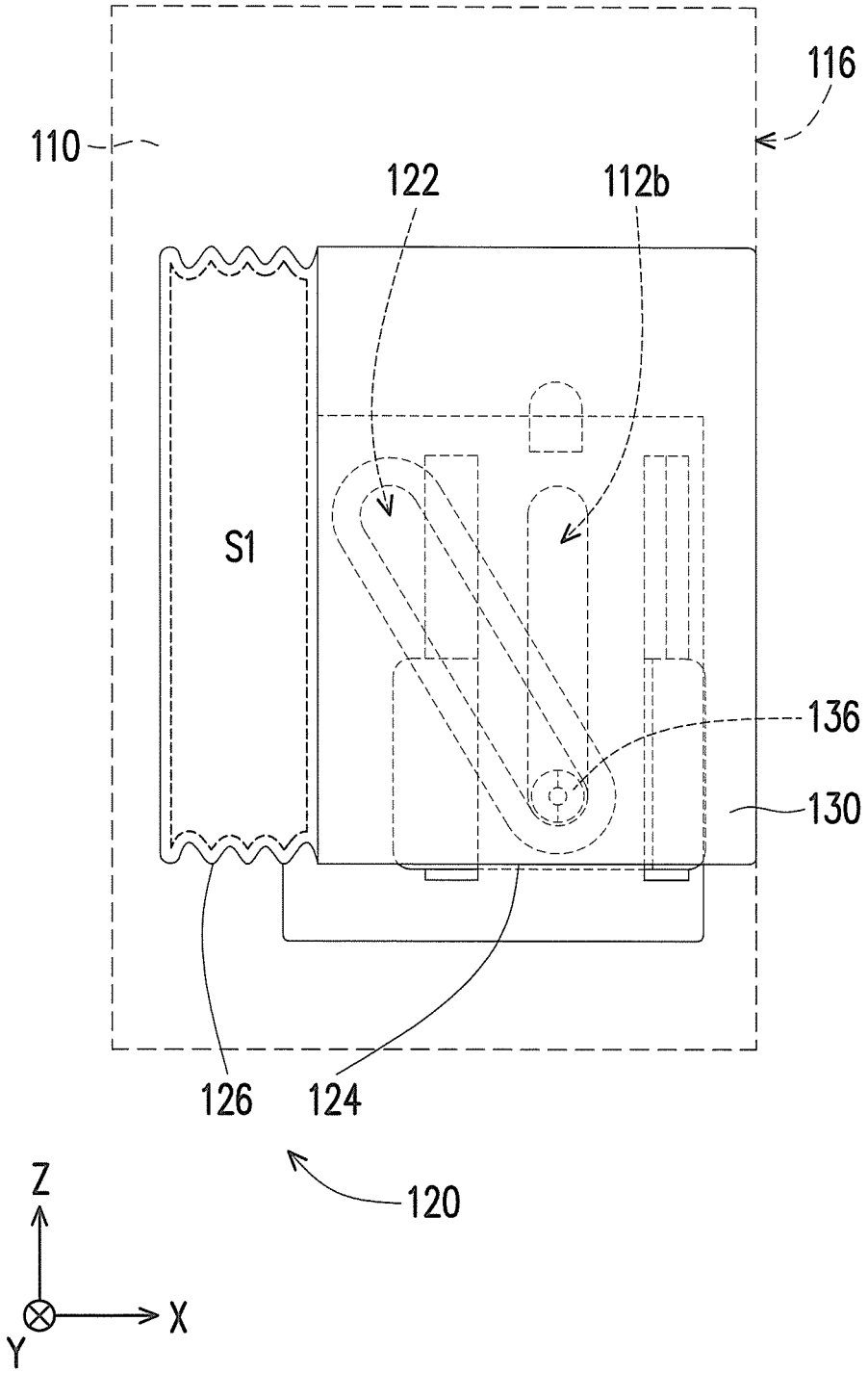
FIGS. 7 and 8 are schematic views illustrating different states between a speaker and a latch.
Figure 8:
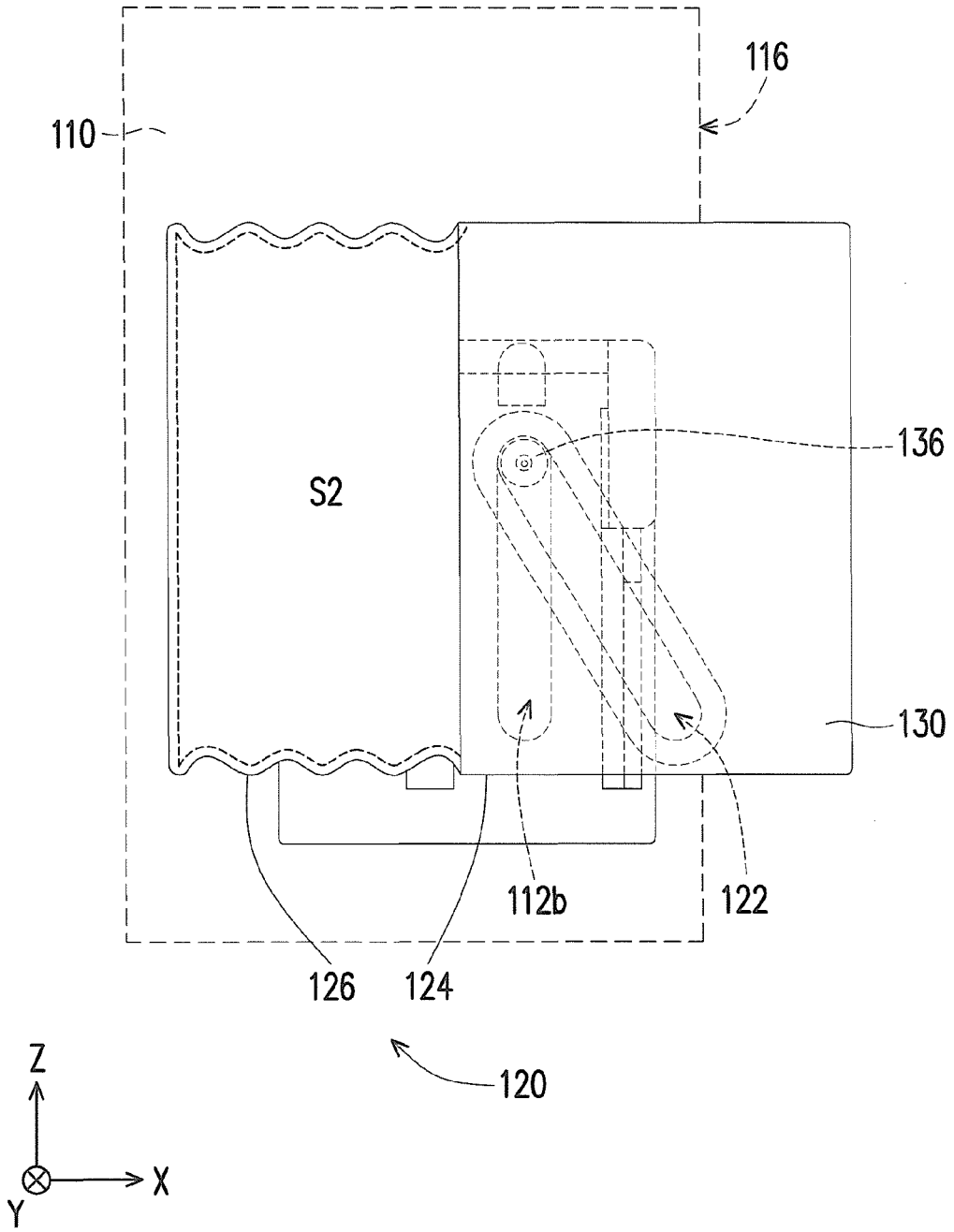

FIGS. 7 and 8 are schematic views illustrating different states between the speaker and the latch. In FIGS. 7 and 8, profile lines of some components are omitted to explicitly specify corresponding relations between the first rail 122 of the speaker 120, the second rail 112*b* of the first body 110, and the latch 130. Referring to FIGS. 7 and 8 together, as noted previously, since the bellows portion 126 of the speaker 120 is capable of expanding or shrinking along the X-axis, the speaker 126 is in a floating state with respect to the first body 110. Therefore, when the protruding part 216 of the second body 210 moves into the notch 112*a*, the latch 130 is pushed to move toward the positive Z-axis direction. Thus, for the speaker portion 124, the pillar 136 of the latch 130 consequently moves along the first rail 122 to drive the speaker portion 124 to move in the positive X-axis direction. Accordingly, making the speaker portion 124 move along the X-axis drives the bellows portion 126 to expand, and a space inside the bellows portion 126 clearly increases from a space S1 shown in FIG. 7 to a space S2 shown in FIG. 8. Thus, for the speaker 120, such design effectively increases a speaker box capacity. In addition, as shown in FIG. 8 (or FIG. 2), the increased speaker box capacity is along a thickness direction (i.e. X-axis) of the electronic device 100. In other words, sound production of the speaker 120 is no longer confined by a profile of an external appearance of the speaker 120. Therefore, even under the trend that pursues a lighter, thinner, and more compact design, the electronic device 100 is still capable of maintaining or gaining the sound effect thereof with the expandable speaker box capacity.

In view of the foregoing, in the embodiments of the invention, the speaker of the electronic device has the first rail, and the first body has the second rail. In addition, an acute angle is included between the first rail and the second rail, and the latch passes through and is coupled to the first rail and the second rail simultaneously, thereby forming the linkage relation between the speaker, the first body, and the latch.

Therefore, when the electronic device is combined with an object (the expansion base in the above embodiments), the latch drives the speaker to protrude from or be submerged into the first body by using the object to drive the latch.

Specifically, the speaker includes the bellows portion disposed inside the first body and the speaker part disposed on the bellows portion. The bellows portion may be driven to expand or shrink, so when the speaker is driven by the latch to protrude out of the first body, the bellows portion expands accordingly. Such design increases the internal space of the bellows portion. Thus, for the speaker, there is a greater speaker box capacity when the speaker protrudes out of the first body. Thus, the speaker is no longer limited to the size of the external appearance. In other words, even though the electronic device is designed with the objective of being thinner, lighter, and more compact, the sound effect of the speaker is still maintained or gained by increasing the speaker box capacity.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An electronic device, comprising:

a body;

a speaker, movably assembled to the body, wherein the speaker has a first rail; and a latch, movably assembled to the body, wherein the latch is coupled to the first rail and a second rail of the body simultaneously, an acute angle is included between the first rail and the second rail, and an object is adapted to be detachably combined to the body and push the latch to move along the first rail and the second rail simultaneously, and the latch drives a part of the speaker to protrude out of the body.

2. The electronic device as claimed in claim 1, wherein the body has a notch, a part of the object is adapted to move into the notch to be combined to the electronic device, the second rail is located on a sidewall inside the notch, and a part of the latch passes through the sidewall to be protruding in the notch and is located on a moving path that the part of the object moves into the notch, when the part of the object moves into the notch, the latch is driven to move along the second rail.

3. The electronic device as claimed in claim 2, wherein a direction of an opening of the notch is parallel to the second rail.

4. The electronic device as claimed in claim 1, wherein the part of the speaker protrudes out of or is submerged into the body along an axial direction, and the axial direction is perpendicular to the second rail.

5. The electronic device as claimed in claim 1, wherein the speaker has a bellows portion and a speaker portion, the bellows portion is disposed inside the body and expands or shrinks along an axial direction, and the speaker portion is disposed on the bellows portion.

6. The electronic device as claimed in claim 1, further comprising:

an elastic member, connected between the body and the latch, wherein when the object is combined to the body to push the latch, the latch deforms the elastic member, and when the object is moved out of the body, the elastic member drives the latch to restore to an original position and drive the part of the speaker to be submerged into the body.

7. An electronic assembly, comprising:

a first body;

a speaker, movably assembled to the first body, wherein the speaker has a first rail;

a latch, movably assembled to the first body, wherein the latch is coupled to the first rail and a second rail of the first body simultaneously, and an acute angle is included between the first rail and the second rail; and a second body, detachably combined to the first body and pushing the latch to move along the first rail and the second rail simultaneously, so as to make the latch drive a part of the speaker to protrude out of the first body.

8. The electronic assembly as claimed in claim 7, wherein the second body has a protruding part, and the first body has a notch, the second rail is located on a sidewall inside the notch, and a part of the latch passes through the sidewall to be protruding in the notch and is located on a moving path that the protruding part moves into the notch, when the second body is combined with the first body, the protruding part drives the latch to move along the second rail.

9. The electronic assembly as claimed in claim 8, wherein a direction of an opening of the notch is parallel to the second rail.

10. The electronic assembly as claimed in claim 7, wherein the part of the speaker protrudes out of or is submerged into the first body along an axial direction, and the axial direction is perpendicular to the second rail.

11. The electronic assembly as claimed in claim 7, wherein the speaker has a bellows portion and a speaker portion, the bellows portion is disposed inside the first body and expands or shrinks along an axial direction, the speaker portion is disposed on the bellows portion, and when the bellows portion expands along the axial direction, a part of the speaker portion protrudes out of the first body.

12. The electronic assembly as claimed in claim 7, further comprising:

an elastic member, connected between the first body and the latch, wherein when the second body is combined to the first body to push the latch, the latch deforms the elastic member, and when the second body is moved out of the first body, the elastic member drives the latch to restore to an original position, and drive the part of the speaker to be submerged into the first body.

13. The electronic assembly as claimed in claim 7, wherein the first body is a portable electronic device, and the second body is an expansion base.

* * * * *